US008309178B2

(12) United States Patent
Seid et al.

(10) Patent No.: US 8,309,178 B2
(45) Date of Patent: Nov. 13, 2012

(54) CORROSION RESISTANT COATING FOR STEEL

(75) Inventors: Alan Seid, Dublin, OH (US); Masayuki Narita, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 579 days.

(21) Appl. No.: 12/508,542

(22) Filed: Jul. 23, 2009

(65) Prior Publication Data

US 2011/0020552 A1 Jan. 27, 2011

(51) Int. Cl.
*B05D 3/02* (2006.01)

(52) U.S. Cl. ..... 427/376.8; 228/262.41; 228/262.5; 420/8; 420/28; 427/383.7; 427/405; 428/548; 428/555; 428/610; 428/653

(58) Field of Classification Search ..... 228/262.4, 228/262.41, 262.5; 420/28, 62, 77, 103; 427/331, 404, 333, 341, 347, 349, 357, 360, 427/367, 376.5, 376.8, 383.7, 402, 405; 428/544, 428/548, 553, 554, 555, 573, 594, 600, 601, 428/610, 636, 637, 638, 649, 650, 652, 653, 428/654, 688, 689

See application file for complete search history.

(56) References Cited

U.S. PATENT DOCUMENTS

| | | | | |
|---|---|---|---|---|
| 3,305,384 | A * | 2/1967 | Tibor | 427/334 |
| 7,238,431 | B2 | 7/2007 | Honda et al. | |
| 2005/0047955 | A1 | 3/2005 | King | |
| 2005/0218121 | A1* | 10/2005 | Hayashi et al. | 219/118 |
| 2005/0274776 | A1* | 12/2005 | Takeda et al. | 228/262.4 |
| 2006/0141280 | A1 | 6/2006 | Kitsuwa | |

FOREIGN PATENT DOCUMENTS

| | | |
|---|---|---|
| GB | 2206358 | 1/1989 |
| JP | 04-052284 | 2/1992 |
| JP | 07-003417 | 1/1995 |
| JP | 11-291388 | 10/1999 |

* cited by examiner

*Primary Examiner* — Michael Cleveland
*Assistant Examiner* — Alexander Weddle
(74) *Attorney, Agent, or Firm* — Capitol City TechLaw, PLLC; Mark E. Duell

(57) ABSTRACT

Provided are methods and initial structures for fabricating corrosion resistant steels that incorporate an aluminum rich corrosion resistant surface layer. The initial structures utilize layering and/or patterning for reducing the effective diffusion length $D_{eff}$ to a value well below the total thickness of the aluminum alloy protective layer $X_1$ by providing vertical and/or lateral laminated structures that provide ready sources of Fe atoms during subsequent heat treatment processes.

7 Claims, 8 Drawing Sheets

CORROSION RESISTANT COATING FOR STEEL

TECHNICAL FIELD

Industrial Applicability

The present disclosure relates to a steel substrate that has been provided with an aluminum containing film and then subjected to heat treatment to provide improved corrosion resistance and weldability to produce a metal sheet that is suitable for subsequent manufacture of appliances, automobiles and building materials. The present disclosure encompasses corrosion-resistant coating compositions, coated steels having an iron-aluminide and/or Fe—Al alloy surface layer and processes for manufacturing such coated steels.

BACKGROUND

Mild steel with an unprotected surface contains iron atoms that are chemically reactive and capable of undergoing electrochemical reactions with a variety of chemical species including water vapor and acidic gasses to form iron oxides. As a result of the differences in iron oxide crystal structures relative to those found in mild steel, iron oxides adhere poorly to the substrate and, as they are dislodged, expose still more steel to electrochemical oxidation. Efforts to protect steel structures from corrosion and, ultimately, structural failure or perforation, are a continuing and expensive burden.

A traditional method of preventing electrochemical oxidation of steel by acidic atmospheric gases and water vapor is simply coating the steel substrate with a barrier material that is relatively impervious to atmospheric oxidants. Such barrier coatings include, for example, various paints, aluminum, zinc, lead, tin and alloys thereof, aluminum oxide, ceramics and other materials. Passive barrier coatings are, however, compromised by any coating imperfections or subsequent damage that will allow oxidants to contact the underlying steel and initiate the corrosion process.

Another method for suppressing the corrosive electrochemical oxidation of steel involved providing a sacrificial coating that is more electrochemically reactive than the underlying steel substrate. Galvanic corrosion protection commonly uses metals such as zinc, aluminum and mixtures thereof to oxidize and thereby prevent underlying steel electrochemical oxidation. These sacrificial coatings, however, suffer from a degradation rate proportional to their oxidant exposure and because the thickness of the galvanic coating is necessarily limited, one must anticipate the sacrificial coating degradation rate for determining the projected useful service life of a steel article protected in such a manner. Weld points and coating imperfections further lessen the operational lifetime of a steel substrate provided with a sacrificial coating.

Additionally, the corrosion resistance of steel substrates can be improved by forming an intermetallic surface layer that is inherently corrosion resistant relative to steel. Although aluminum-steel alloys such as iron aluminide are well-known, controlling the reaction of a steel surface with a metal coating to form an intermetallic surface alloy of sufficient thickness and composition to provide corrosion resistance remains a challenge. Furthermore, the ductility, strength and weldability of such intermetallic alloys relative to an underlying steel substrate can create subsequent fabrication issues.

Steel used in automobile manufacture is typically formulated, treated and/or coated in order to suppress corrosion. A number of techniques and materials have been developed over the years for improving the corrosion resistance of the steel including, for example, hot dipping the steel in a bath of molten aluminum or aluminum alloy. Hot dip aluminum coated steel typically exhibits improved resistance to salt corrosion and has been used in, for example, automotive exhaust systems and body panels.

Increasing temperatures associated with the introduction of catalytic converters and other combustion management techniques have tended to increase both the temperature and the corrosiveness of the resulting combustion gases. The need for improved high temperature corrosion resistance led some manufacturers to begin replacing aluminum coated low carbon or low alloy steels with aluminum coated chromium alloy steels.

One of the mechanisms providing the improved corrosion resistance of the aluminum coated steels is the heat induced diffusion or transfer of at least a portion of the aluminum coating layer into the predominately iron base to form an intermetallic Fe—Al alloy layer. As will be appreciated by one skilled in the art, the particular structure, morphology and stoichiometry of the resulting Fe—Al alloy depends on a number of factors including, for example, the initial composition and the specific heat treatment procedure utilized in forming the alloy. As will also be appreciated by those skilled in the art, the structure of aluminum coated steels used in higher temperature applications may continue to change over the life of the part, a fact which will tend to guide the selection and formation of the initial structure and composition.

As noted above, one category of methods for manufacturing corrosion resistant coated steel involves subjecting the base steel to a "hot dip" in a bath of molten coating metal including, for example, aluminum, zinc and/or alloys and combinations thereof. One variation of the basic hot-dip technique, sometimes referred to as the Sendzimir process, prepares the steel by passing it through an oxidizing furnace where it is heated, without atmosphere control, to a temperature on the order of 1600° F. (870° C.). The heated steel is withdrawn from the furnace into air or another oxidizing ambient and allowed to form a surface oxide. The oxidized steel is then introduced passed through a reducing furnace containing a reducing atmosphere, for example, a mixture of hydrogen and nitrogen, and maintained under these conditions for a period sufficient to bring the strip to a reaction temperature of at least about 1350° F. (732° C.) and thereby reduce the surface oxide. The reduced steel surface is then typically maintained under a non-oxidizing until it is introduced into a selected molten metal bath.

Another variation of the basic hot-dip technique, sometimes referred to as the Turner or Selas process, involves passing the steel through a furnace heated to a temperature of at least 2200° F. (1204° C.) while maintaining a furnace atmosphere with little or no free oxygen and at least 3% excess combustibles. The steel is maintained under this environment for a period sufficient to heat the steel surface to a temperature of at least about 800° F. (427° C.) while suppressing surface oxidation. The heated steel is then moved into a reducing furnace under a hydrogen-nitrogen atmosphere and cooled to a temperature appropriate for introduction into the molten coating metal bath. Still others have proposed reducing or eliminating nitrogen from the surface treatment, particularly with chromium steels.

One of the difficulties associated with the hot dip coating method, particularly with respect to hot dip coating of aluminum and its alloys, is ensuring that the steel surface is sufficiently "wettable" by the molten coating metal so that a uniform coating layer may be formed during continuous manufacturing. One technique proposed for improving the wettability of steel containing one or more alloying metals, for example, no more than 5% chromium, no more than 3% aluminum, no more than 2% silicon and/or no more than 1% titanium, by heating the steel to a temperature above 1100° F. (593° C.) in an oxidizing atmosphere to form a surface oxide layer and then treating the oxide with reducing conditions in an effort to obtain a surface layer exhibiting an iron matrix containing a relatively uniform dispersion of oxides of the alloying element(s).

Despite various approaches, the limited wettability of molten aluminum coatings, particularly on stainless steels remains a concern in the industry. Poorly adhering hot dip aluminum coatings may exhibit flaking or crazing of the coating during metal deformation. Post dip heat treatments and rerolling techniques have been used to improve the initial adherence of the aluminum layer. Other manufacturers have adopted batch type hot dip coating processes, spray coating processes and/or extended dip duration, each of which can adversely impact throughput and/or uniformity.

Other approaches for improving the corrosion resistance have also included subjecting the aluminum coated steel to a chromate treatment and/or increasing the thickness of the aluminum coating itself. In higher temperature applications, e.g., those in which the resulting article will be exposed to temperatures of 300° C. or more, however, the chromate film produced provides less corrosion resistance and thicker aluminum coatings can exhibit peeling (delamination) as the steel is deformed during subsequent manufacturing processes.

One method for improving the adhesion and/or the corrosion resistance involves heat treating the aluminum coated steel under conditions that produce alloyed regions. The addition of a heat treatment process, however, increases the complexity of the manufacturing process and introduces additional variability in the quality and adhesion of the resulting aluminized steel. As will be appreciated by those skilled in the art, the process of diffusing aluminum into steel is not accurately reflected by simple diffusion models but rather by more complex reaction diffusion. The various localized compositions resulting from such a process may, in some instances, complicate later fabrication processes including, for example, stamping and/or welding.

Although generally referenced throughout this disclosure as an Fe—Al system, those skilled in the art will also appreciate that other alloying elements will typically be present in the dominate iron and aluminum compositions and will have greater or lesser impact on the diffusion system depending on their nature and concentration. A number of other elements and combinations thereof have been used in forming aluminum alloys and/or may be present as contaminates or introduced during processing. Antimony, in trace amounts (0.01 to 0.1 ppm), can be used instead of bismuth to counteract hot cracking in aluminum-magnesium alloys. Beryllium (typically up to 0.1%) can be used in aluminum/magnesium alloys for reducing oxidation at elevated temperatures, improving adhesion of the aluminum film to steel and for suppressing formation of deleterious iron-aluminum complexes. Low-melting-point metals such as bismuth, lead, tin, and cadmium may be added to improve machinability of aluminum alloys by promoting chip breaking and lubricating the cutting tool; boron may be used as a grain refiner and for improving conductivity by precipitating vanadium, titanium, chromium, and molybdenum, becoming more effective when used with an excess of titanium.

Cadmium may accelerate the rate of age hardening, increase strength, and increase corrosion resistance of aluminum-copper alloys and, at levels of 0.005 to 0.5%, has been used to reduce the time of aging of aluminum-zinc-magnesium alloys. Carbon may be present as an impurity and form oxycarbides and carbides with aluminum or other impurities and, as $Al_4C_3$ decomposes in the presence of water and water vapor, has been associated with surface pitting. Chromium may be present as a minor impurity in commercial grade aluminum and has a pronounced effect on electrical resistivity or, in amounts generally not exceeding 0.35%, may be used in aluminum-magnesium, aluminum-magnesium-silicon and aluminum-magnesium-zinc alloys to control grain structure, to prevent grain growth in aluminum-magnesium alloys, and to suppress recrystallization in aluminum-magnesium-silicon and aluminum-magnesium-zinc alloys during hot working or heat treatment.

Aluminum-copper alloys containing 2 to 10% Cu, typically with one or more other additions, form an important family of aluminum alloys that tend to respond to solution heat treatment and subsequent aging with increased in strength and hardness and a decrease in elongation. The main benefit of adding magnesium to aluminum-copper alloys is the increased strength possible following solution heat treatment and quenching. Cast aluminum-copper-magnesium alloys containing iron are typically characterized by dimensional stability and improved bearing characteristics, as well as by high strength and hardness at elevated temperatures. In certain compositions, however, iron concentrations as low as 0.5% may be associated with reduced tensile properties in the heat-treated condition, particularly if the silicon content is not sufficient to tie up the iron as FeSi constituents.

Hydrogen has a higher solubility in molten aluminum than in the solid at the same temperature. As a result, certain of the preconditioning methods above in which the steel surface is maintained under a reducing atmosphere, primary gas porosity can form during solidification and has been associated with secondary porosity, blistering, and high-temperature deterioration (advanced internal gas precipitation) during heat treating and may play a role in grain-boundary decohesion during stress-corrosion cracking. Hydrogen level in aluminum melts may be controlled by fluxing with hydrogen-free gases and/or by vacuum degassing. Small quantities (0.05 to 0.2%) of indium may have a significant influence on the age hardening of aluminum-copper alloys, particularly those with lower copper content, e.g., 2 to 3% Cu.

Iron is the most common impurity found in aluminum. It has a high solubility in molten aluminum and is therefore easily dissolved at all molten stages of production. The solubility of iron in the solid state is very low (~0.04%) and therefore, most of the iron present in aluminum over this amount appears as an intermetallic second phase in combination with aluminum and often other elements. Lead is normally present only as a trace element in commercial grade aluminum, but may be added at levels of about 0.5%, typically in a 1:1 atomic ratio with bismuth to improve machinability.

The solid solubility of nickel in aluminum does not exceed 0.04% and in excess quantities will generally be present as an insoluble intermetallic, usually in combination with iron. Nickel levels of, for example, up to 2%, tend to increase the strength of high-purity aluminum but can also result in corresponding reductions in ductility. Nickel may be added to aluminum-copper or aluminum-silicon alloys for improving hardness and strength at elevated temperatures and reducing the coefficient of expansion of the resulting composition.

Silicon, after iron, is the highest impurity level in electrolytic commercial aluminum (0.01 to 0.15%) and, in wrought alloys, may be used with magnesium at levels up to 1.5% to produce $Mg_2Si$ in heat-treatable alloys. Magnesium added to aluminum-zinc alloys tends to improve the strength potential of the resulting alloy system, especially in the range of 3 to 7.5% Zn, with the magnesium and zinc forming $MgZn_2$ and providing an increased response to heat treatment relative to the binary aluminum-zinc system. Adding copper to the aluminum-zinc-magnesium system, together with small amounts of chromium and manganese, produces some of the highest-strength aluminum-base alloys commercially available. It is believed that the copper increases the aging rate by increasing the degree of supersaturation and, possibly, through nucleation of the $CuMgAl_2$ phase.

SUMMARY OF THE DISCLOSURE

As noted above, the corrosion resistance of steel can be improved by depositing aluminum and/or an aluminum alloy on the ferrous base material in a manner that reduces the effective diffusion length $D_{Leff}$ and then subjecting the combination to appropriate heat treatment. The heat treatment is performed at temperatures and for sufficient time to allow the aluminum and iron (as well as any alloying elements) to form a plurality of Fe—Al compositions and morphologies. One of the limiting parameters for this process is the amount of time required at a given temperature to ensure that sufficient diffusion has been achieved. While thicker layers may provide improved resistance they also require additional diffusion time to achieve acceptable results, the time required being a function of the film thickness $X_1$ of the overlying layer that the Fe atoms must traverse.

As disclosed in more detail below, the disclosed method modifies the initial configuration of the initial iron/aluminum structure in order to reduce the heat treatment time by reducing the effective diffusion length to well below the actual film thickness. Utilizing the disclosed methods and structures in the manufacture of aluminized steels will tend to suppress formation of undesirable species and/or layers, improve the corrosion resistance of the resulting materials and/or improve the weldability of the resulting materials.

As detailed below, the modified structure may incorporate horizontal and/or vertical patterns of dissimilar materials in order to provide an initial structure that, after appropriate heat treatment will provide an aluminum enriched surface layer on the base steel material. As also detailed below, the modified structure may be fabricated using a variety of deposition and surface modification techniques to achieve a wide variety of initial structures that will, in turn, produce different combinations of Fe—Al morphologies. Those of ordinary skill in the art may then utilize variations of the structures and techniques to achieve an application specific result.

As noted above, additional materials may be included in the aluminum and/or the steel for controlling other parameters including, for example, grain sizing, hardness and ductility of the final product. As will be appreciated by those skilled in the art, although the disclosure may refer to "aluminum" and "iron" layers, these references to the primary elements are simply for convenience and should not be interpreted as unduly limiting. Indeed, unless specifically excluded or made clear by the context, references to aluminum and iron herein should be understood as encompassing alloys (e.g., steel) and mixtures incorporating other materials.

BRIEF DESCRIPTION OF THE FIGURES

Example embodiments described below will be more clearly understood when the detailed description is considered in conjunction with the accompanying drawings, in which.

It should be noted that these Figures are intended to illustrate the general characteristics of methods, structures and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments.

DETAILED DESCRIPTION

Figure 9:
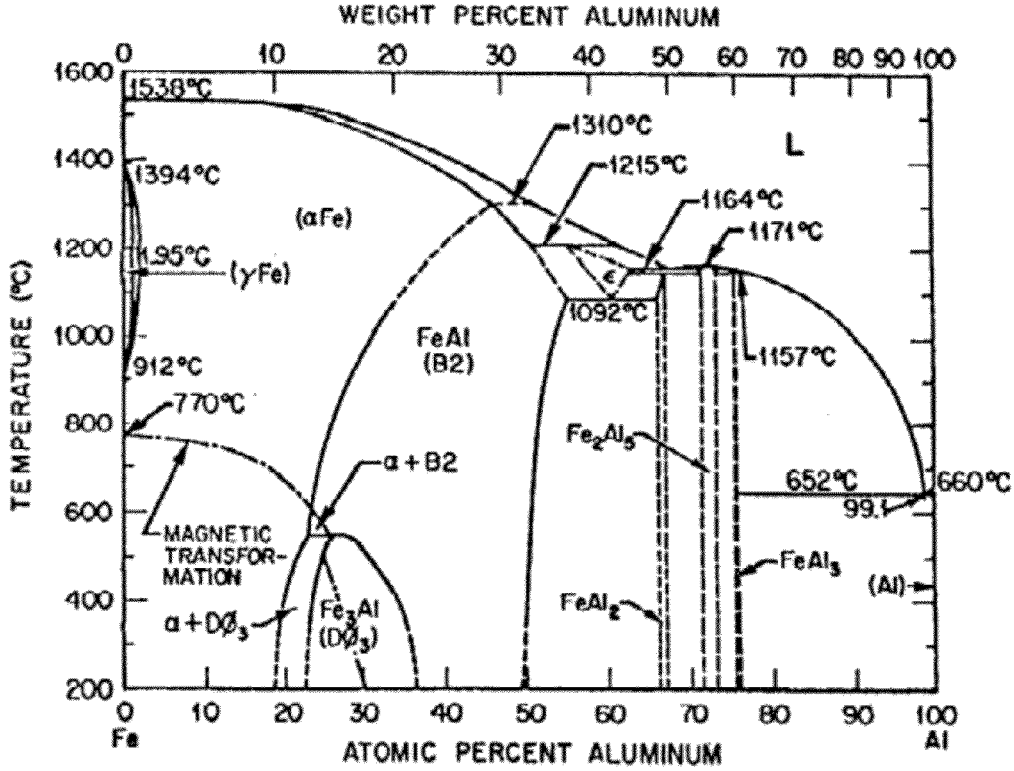
FIG. 9 is a phase diagram for an Fe—Al system.

As reflected in FIG. 9, depending on the atomic ratio and the heat treatment profile to which a material has been subjected, an Fe—Al system may include a number of species including, for example, $\alpha Fe$, $\gamma Fe$, $Fe_3Al$, FeAl, $FeAl_2$, $Fe_2Al_5$ and $FeAl_3$, each of which is characterized by a corresponding microstructures, microhardness and density. The $FeAl_2$, $Fe_2Al_5$ and $FeAl_3$ phases, for example, tend to exhibit increased brittleness in the Fe—Al alloy layer.

Thermal processing of steel and aluminum structures, in light of the different thermal properties of the two materials including, for example, thermal expansion, heat capacity, and thermal conductivity may produce very complex stress fields. Other changes associated with thermal processing of such structures include lattice transformation and the formation of mixed intermetallic phases. The intermetallic phases can exhibit both complex lattice structures and microhardness values in excess of 1,000 HV (Hardness/Vickers).

In iron (cubic body-centered up to about 911° C.) and aluminum (cubic face-centered) joints, these mixed phases may be characterized increased hardness and reduced ductility relative to the bulk properties. Accordingly, thermal processes are typically designed to suppress the formation of undesirable intermetallic phases, maintain the formation of intermetallic phases within acceptable limits and/or prevent the formation of intermetallic phases in the first place.

As reflected in FIG. 9, although only relatively small quantities of iron can be dissolved in aluminum and, correspondingly, only relatively small quantities of aluminum can be dissolved in iron, iron and aluminum can form a range of intermetallic phases. Comparing the relative effects of the intermetallic phases suggests that $Fe_2Al_5$ and $FeAl_3$ have more negative performance characteristics than the other phases. In particular, the $Fe_2Al_5$ phase, with its columnar crystalline structure and high hardness seems to have the more negative influence on the performance characteristics of the resulting alloy. As also reflected in FIG. 9, Fe—Al alloys, particularly those having less than 50 atomic percent aluminum, exhibit paramagnetic, ferromagnetic, and spin-glass regions.

Although a variety of new materials have been developed or proposed, steel remains the principal construction material for automobiles, appliances, and industrial machinery. As a result of steel's vulnerability to attack by aggressive chemical environments or even from simple atmospheric oxidation, some form of metal coating is necessary for most applications in order to afford some degrees of protection. Various methods have been utilized, ranging from hot-dip and electroplating processes to tough polymer and ceramic coatings. In general, corrosive environments contain more than one corrosive agent, and the coating selected should be one that resists penetration by any combination of anticipated corrosives, oxidizers, solvents and combinations thereof. Accordingly, the preferred surface treatments are those that produce a barrier that can resist corrosion from a range of agents.

As noted above, a number of methods and techniques may be utilized for forming or depositing aluminum layers on an underlying steel substrate. Two basic types of hot-dip aluminum-coated steel are readily available, each of which provides a different kind of corrosion protection. Those coated steels designated as Type 1 will typically include an aluminum-silicon metal coating that provides improved resistance to both heat and corrosion which those designated as Type 2 will typically include a hot-dipped metal coating of commercially pure aluminum that provides improved durability and protection from atmospheric corrosion.

Another method of forming or depositing aluminum layers on an underlying steel substrate involves electroplating in which the substrate is immersed in a plating bath and electrical current is applied to induce the deposition of metal ions within the plating bath onto the surface of the substrate. As will be appreciated by one skilled in the art, a variety of plating bath compositions and equipment configurations may be utilized in forming a plated layer of a dissimilar material or materials. Indeed, nickel, copper and chromium are probably more widely used for plating base structures of steel and/or brass than aluminum. A variety of electroplating processes such as Fast Rate Electrodeposition ("FRED") have been introduced for improving various parameters including, for example, the deposition rate, uniformity and/or address environmental concerns.

Another method of forming or depositing aluminum layers on an underlying steel substrate involves electroless plating processes which, in contrast to conventional electroplating, utilizes a chemical reaction rather than an electric current to induce metal deposits on the target surface. With electroless metal coating processes the deposition thickness is typically controlled simply by controlling the immersion time of the autocatalytic process. Electroless coating processes may, perhaps, be more accurately described as conversion coatings, because they produce a protective layer on the substrate surface through one or more chemical reactions.

Another trend in composite electroless metal coating involves the co-deposition of one or more desired particulates within a metal matrix. Commercially available coatings may incorporate one or more particulates including, for example, diamond, silicon carbide, aluminum oxide and/or polymers such as polytetrafluoroethylene ("PTFE") and may be applied to most metals, including iron, carbon steel, cast iron, aluminum alloys, copper, brass, bronze, stainless steel, and high alloy steels.

Metal layers may also be formed using sputtering processes by which thin, adherent films may be deposited from a low pressure plasma environment onto virtually any substrate. Sputter metal coating can provide several advantages over conventional plating processes including, for example, improved uniformity, reduced energy consumption and reduced waste materials, particularly with respect to disposal of contaminated metallic solutions. Sputter metal coating provides certain other advantages by providing for the deposition of various metals and various refractory compounds such as carbides, nitrides, silicides and/or borides without materially altering the substrate properties, thereby providing the artisan with more control over both the initial and final structures. And because sputter metal coating is not limited by thermodynamic criteria, film properties can be tailored in ways simply not possible with conventional deposition methods that require significant thermal inputs to the substrate.

Another technique available for forming metal layers on a substrate is ion plating. The basic difference between sputter metal coating and ion plating is the manner in which the deposited material is separated from the source. In sputter metal coating the deposited material is generated from a source by impact evaporation and transferred by a momentum transfer process. In contrast, in ion plating the deposited material (evaporant) is generated by thermal evaporation from one or more sources. Ion plating, therefore, can combine the high throwing power of electroplating, the high deposition rates of thermal evaporation with the high energy impingement of ions and energetic atoms associated with sputtering and ion-implantation processes.

Ion plated coatings tend to provide excellent adherence that has been attributed to the formation of a graded interface between the deposited film and substrate, even in those instances in which the two materials would generally be considered to be incompatible. The graded interface is also believed to strengthen the surface and subsurface zones with resulting increases in fatigue life of the resulting article.

Metal coatings may also be deposited by arc spraying in which the coating metal is fed into an arc region in which an electric arc liquefies the metal while a gas jet directs the molten metal toward the substrate. Because the particle velocity can be varied considerably, the arc spraying process can be utilized to produce a range of metal coating finishes ranging from very fine to coarse textures. The composition of the resulting layer may also be adjusted by feeding various materials into the arc region at different rates, either sequentially or in combination. In some instances gradient coatings can be applied wherein, for example, the substrate is coated with a first material that provides a good bond and has characteristics more compatible with the substrate with the deposition then switching gradually to a second material that will provide a preferred surface layer to provide, for example, improved wear or corrosion resistance, improved solderability or weldability and/or desired surface roughness characteristics and thermal performance.

As deposited, arc sprayed metal coating are generally somewhat porous, being composed of many overlapping platelets and can be thicker than those achieved by hot dipping, ranging from 3 to 5 mil for light-duty, low-temperature applications to 7 to 12 mil for severe service applications. Because zinc and aluminum tend to be, under most conditions, more corrosion resistant than steel, they are widely used in arc sprayed metal coating processes. In addition, because both zinc and aluminum are anodic to steel, they can provide galvanic protection for the underlying ferrous substrates with aluminum being considered more durable in acidic environments and zinc generally performing better in alkaline conditions.

Metal coating may also be formed by plasma spraying in which a hot, high-speed plasma flame (generated from, for example, nitrogen, hydrogen, or argon) is used to melt a source material and spray it onto the substrate. A direct-current arc may be utilized for striking the plasma and maintaining the functional gases in the plasma state for the duration of the deposition process. The high temperature plasma, which may reach temperatures in excess of 8,300° C. (15,000° F.), enables this process to handle a variety of metal coating materials as well as ceramics, carbides and plastics while still maintaining substrate temperatures below about 121° C. (250° F.).

The mechanical properties of the metals and composite metal systems are typically described or defined in terms of the manner in which the subject metal reacts to four basic stresses: tension, compression, shear, and torsion. Tensile strength is the ability of a metal to resist being pulling forces and may be presented as a stress-strain curve from which may be determined the material's yield strength, yield point, ultimate tensile strength and modulus of elasticity.

Yield strength is the maximum stress that may be applied to a material without causing permanent deformation and the yield point is that point in the stress-strain curve where stress and strain are no longer proportional (or linear). The ultimate tensile strength is the maximum stress the material can endure, i.e., the high point on a stress-strain curve. The modulus of elasticity represents a measure of the rigidity or stiffness of the material. Ductility refers to the ability of a material to be deformed without failure and, with steels, can vary greatly even for compositions exhibiting similar elasticity. Hardness refers to the ability of a material to resist indentation and is generally measured using a standard measurement technique as defined by the American Society for Testing and Materials ("ASTM"), Vickers, Shore, Brinell or Rockwell procedures and scales.

Figure 1A:
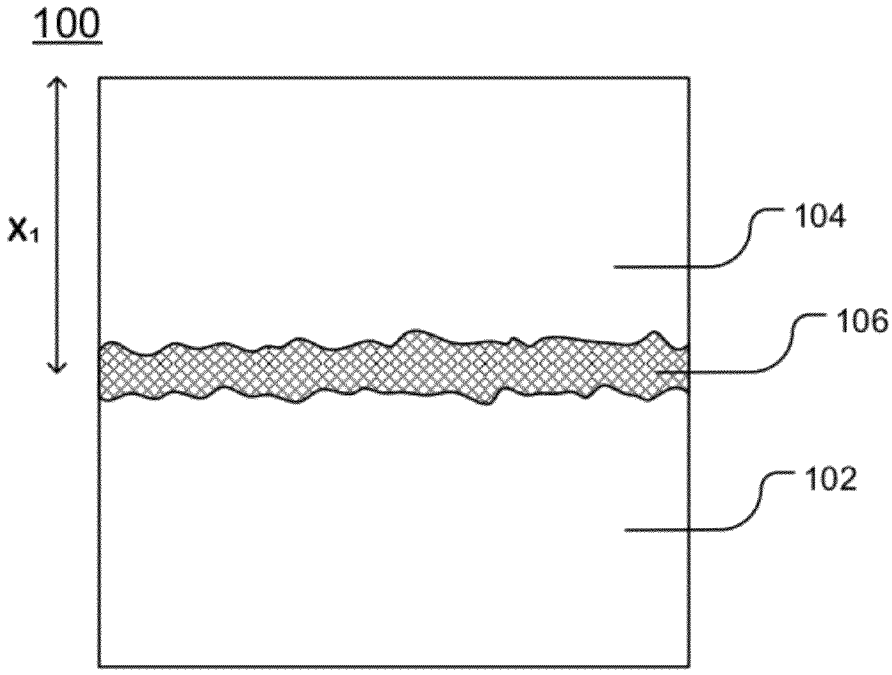
FIG. 1A (CONVENTIONAL ART)
FIG. 1A illustrates a conventional hot dip application of an aluminum layer on a base iron substrate and FIG. 1B illustrates the conventional structure of FIG. 1A after heat treatment.
Figure 1B:
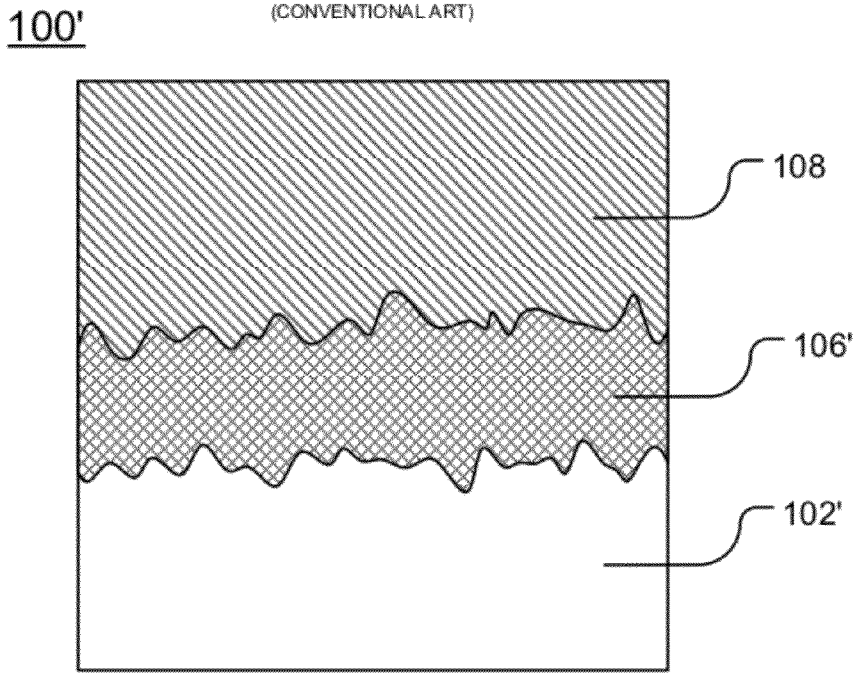
FIG. 1B (CONVENTIONAL ART)

As illustrated in FIG. 1A, a conventional aluminum hot dip process for coating steel tends to produce an initial structure 100 that includes a ferrous substrate 102, an aluminum coating layer 104 having a thickness $X_1$ and an interfacial region 106 that has a composition falling between the ferrous and aluminum layers. As illustrated in FIG. 1B, after heat treatment to produce the final coated steel article 100', diffusion of Fe atoms from the substrate material 102' through the coating layer produces an iron aluminide layer 108 that will generally still comprise more than 50 at % aluminum and an expanded interfacial region 106' that is generally still more than 50 at % iron. As will be appreciated by those skilled in the art, although thicker coating layers can provide improved corrosion resistance, the increase in the $X_1$ distance will tend to require additional thermal treatment time and/or increased temperatures in order to achieve the desired final structure.

Figure 2A:
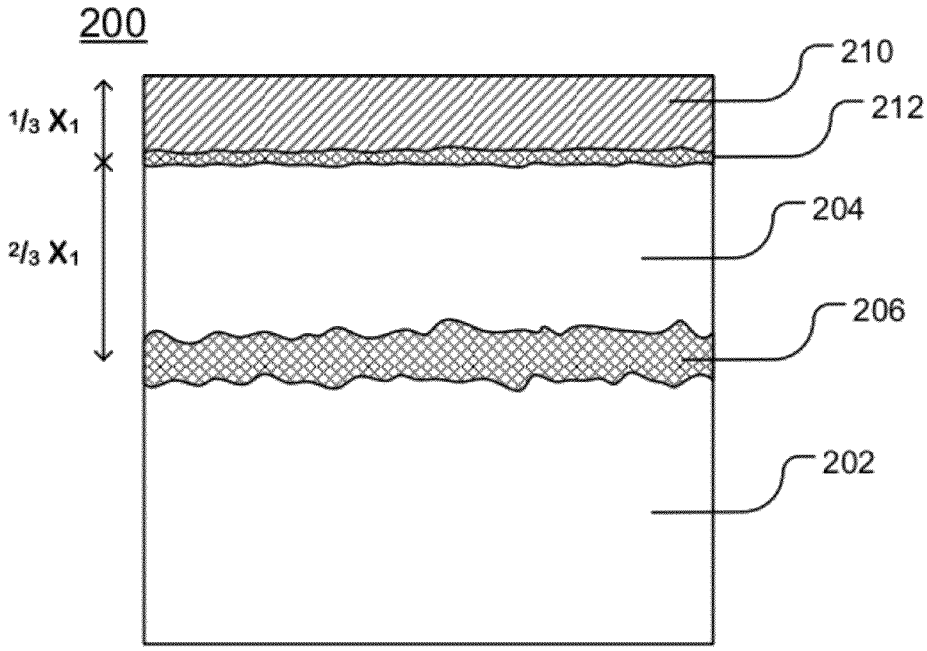
FIG. 2A illustrates an example embodiment of an initial structure manufactured according to the disclosure and FIG. 2B illustrates the structure of FIG. 2A after heat treatment.

As illustrated in FIG. 2A, an example embodiment of an initial structure 200 according to the disclosure that includes a ferrous substrate 202, an aluminum coating layer 204 having a thickness of about ⅔ $X_1$ and a first interfacial region 206 that has a composition falling between the ferrous substrate and aluminum layers, a ferrous coating layer 210 having a thickness of about ⅓ $X_1$ and a second interfacial region 212 that has a composition falling between the ferrous and aluminum coating layers.

Figure 2B:
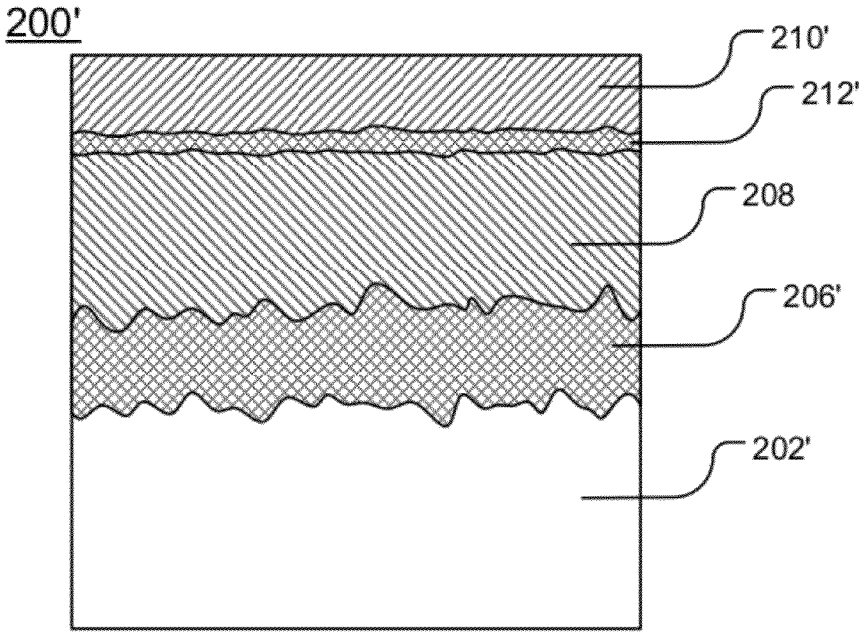

As illustrated in FIG. 2B, after heat treatment to produce the final coated steel article 200', diffusion of Fe atoms from both the substrate material 202' and the ferrous coating layer 210 through the aluminum coating layer 204 produces an iron aluminide layer 208 that will generally still comprise more than 50 at % aluminum and expanded interfacial regions 206' and 212'. By reducing the thickness of the aluminum coating layer 204 and providing a second source of Fe atoms, the structure illustrated in FIG. 2A allows the thickness of the composite protective layer to be maintained on the substrate while allowing the Fe—Al alloys to be formed successfully with reduced thermal processing which, in turn, may suppress the formation of undesirable species within the alloyed layer.

Figure 3A:
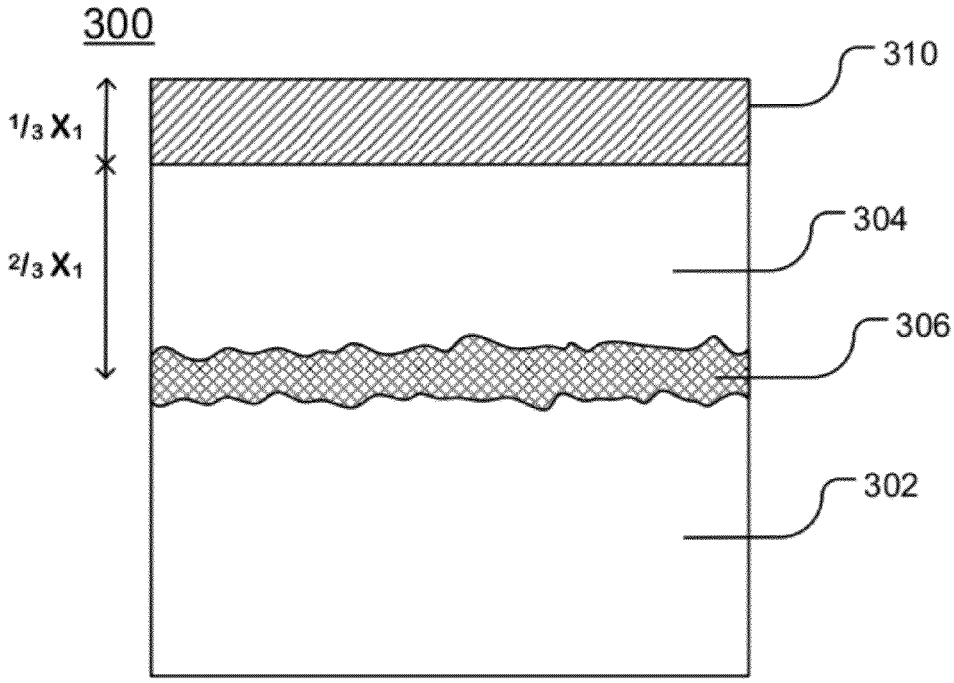
FIG. 3A illustrates another example embodiment of an initial structure manufactured according to the disclosure and FIG. 3B illustrates the structure of FIG. 3A after heat treatment.

As illustrated in FIG. 3A, an example embodiment of an initial structure 300 according to the disclosure that includes a ferrous substrate 302, an aluminum coating layer 304 having a thickness of about ⅔ $X_1$ and a first interfacial region 306 that has a composition falling between the ferrous substrate and aluminum layers, a ferrous coating layer 310 having a thickness of about ⅓ $X_1$ that was formed using a coating process that suppressed formation of a second interfacial region.

Figure 3B:
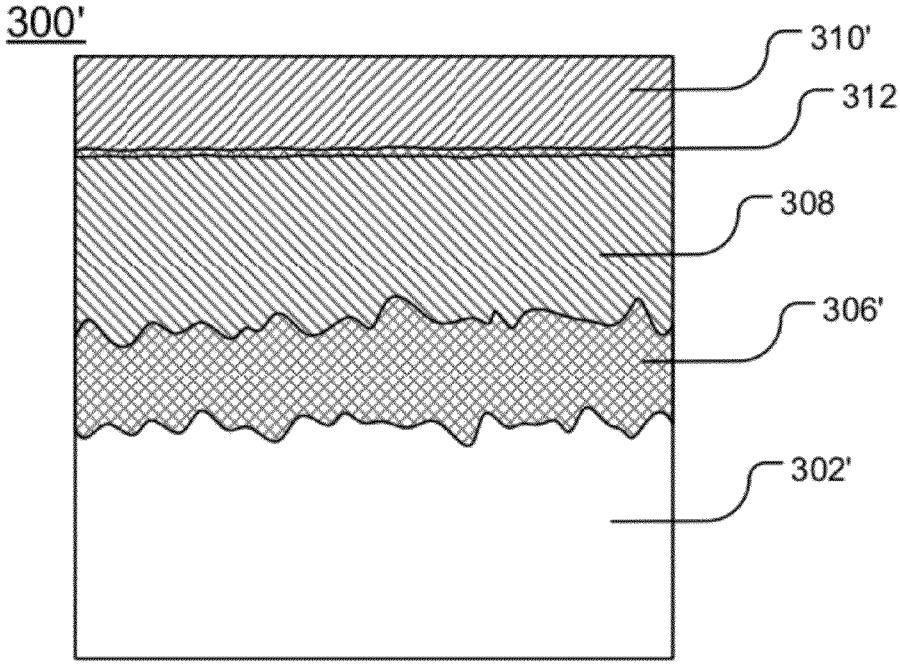

As illustrated in FIG. 3B, after heat treatment to produce the final coated steel article 300', diffusion of Fe atoms from both the substrate material 302' and the ferrous coating layer 310 through the aluminum coating layer produces an iron aluminide layer 308 that will generally still comprise more than 50 at % aluminum and interfacial regions 306' and 312. By reducing the thickness of the aluminum coating layer 304 and providing a second source of Fe atoms, the structure illustrated in FIG. 3A allows the thickness of the composite protective layer to be maintained on the substrate while allowing the Fe—Al alloys to be formed successfully with reduced thermal processing which, in turn, may suppress the formation of undesirable species within the alloyed layer and the formation of the second interfacial layer.

Figure 4A:
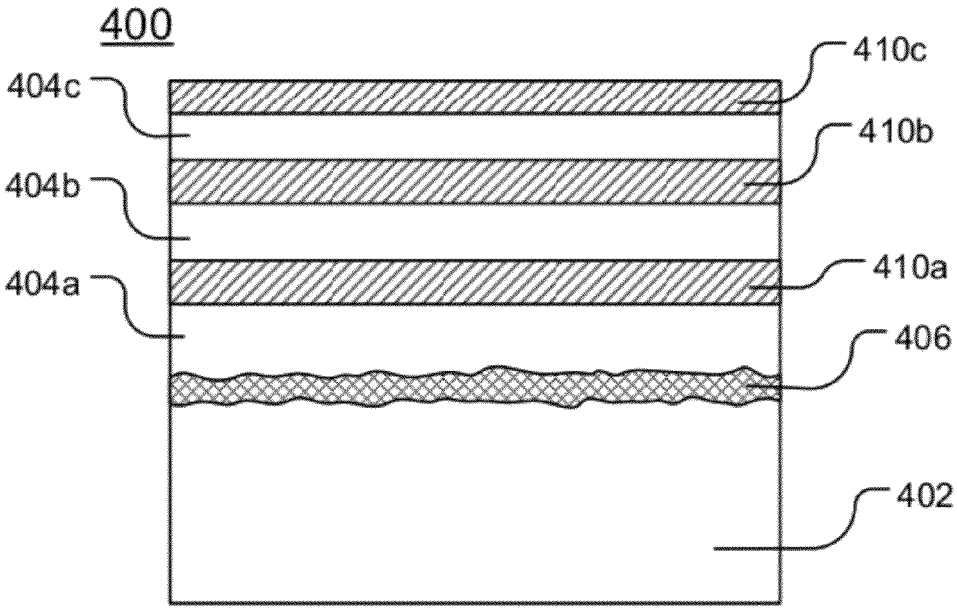
FIGS. 4A and 4B illustrate two additional example embodiments of initial structures manufactured according to the disclosure.

As illustrated in FIG. 4A, an example embodiment of an initial structure 400 according to the disclosure that includes a ferrous substrate 402, a first aluminum coating layer 404*a*, a first interfacial region 406 that has a composition falling between the ferrous substrate and the first aluminum coating layers, a first ferrous coating layer 410*a*, a second aluminum coating layer 404*b*, a second ferrous coating layer 410*b*, a third aluminum coating layer 404*c* and a third ferrous coating layer 410*c*, the subsequent coating layers being formed using a coating process suppressed formation of multiple interfacial regions. By reducing the thicknesses of the aluminum and ferrous coating layers and providing a second source of Fe atoms for each of the aluminum coating layers, the structure illustrated in FIG. 4A allows the thickness of the composite protective layer to be maintained on the substrate while allowing the Fe—Al alloys to be formed successfully with further reduced thermal processing which, in turn, may suppress the formation of undesirable species within the alloyed layer.

Figure 4B:
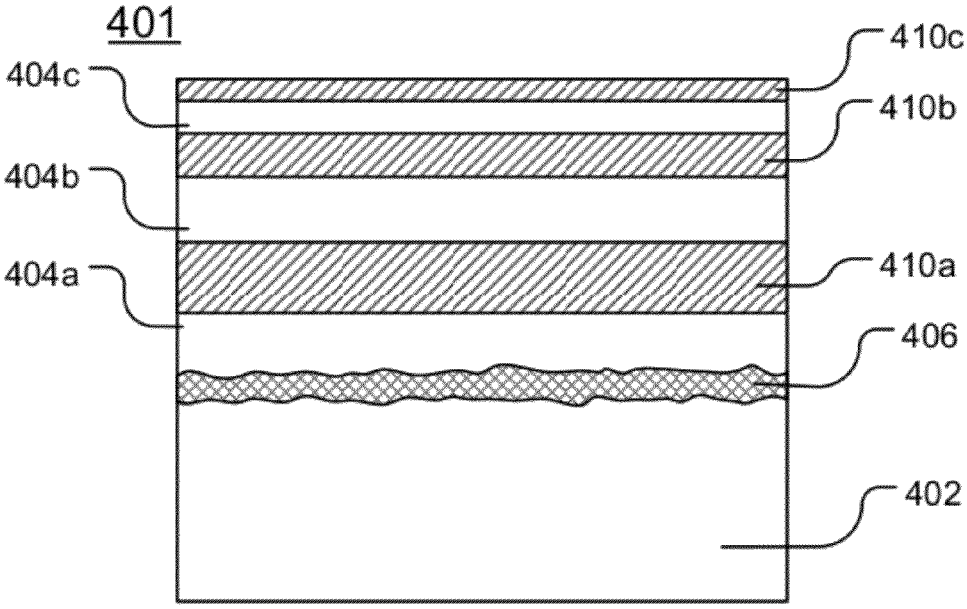

As illustrated in FIG. 4B, an example embodiment of an initial structure 401 according to the disclosure that includes a ferrous substrate 402, a first aluminum coating layer 404*a*, a first interfacial region 406 that has a composition falling between the ferrous substrate and the first aluminum coating layers, a first ferrous coating layer 410*a*, a second aluminum coating layer 404*b*, a second ferrous coating layer 410*b*, a third aluminum coating layer 404*c* and a third ferrous coating layer 410*c*, the subsequent coating layers being formed using a coating process suppressed formation of multiple interfacial regions.

As illustrated in FIG. 4B, however, the relative thicknesses of the aluminum and ferrous coating layers may be utilized for increasing the local concentrations of one metal or the other to provide further control over the resulting alloy composition. Similarly, the individual aluminum and ferrous layers may include varying concentrations of one or more minor alloying elements including, for example, silicon, zinc, nickel and/or magnesium, for providing additional control over the properties of the final structure.

As with the embodiment illustrated in FIG. 4A, the initial structure illustrated in FIG. 4B reduces the thicknesses of the aluminum and ferrous coating layers and provides a second source of Fe atoms for each of the aluminum coating layers, thereby allowing the thickness of the composite protective layer to be maintained on the substrate while allowing the Fe—Al alloys to be formed successfully with reduced thermal processing which, in turn, may suppress the formation of undesirable species within the alloyed layer. As will be appreciated by those skilled in the art, while the thermal processing may be reduced relative to conventional processing for protective aluminum alloy layers of similar thickness, an artisan may utilize the illustrated structures for increasing the thickness of the protective aluminum alloy layers with more conventional thermal processes.

Figure 5A:
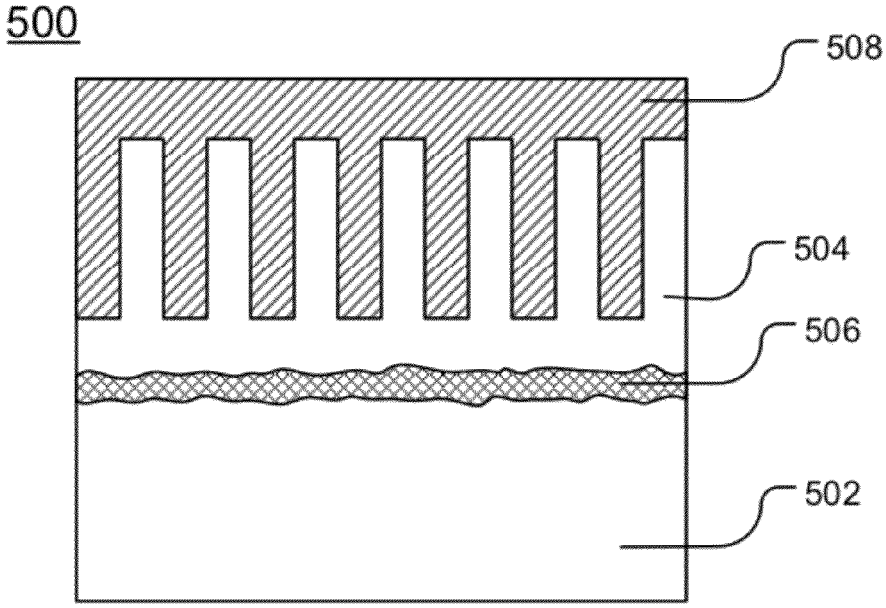
FIGS. 5A and 5B illustrate two additional example embodiments of initial structures manufactured according to the disclosure.

As illustrated in FIG. 5A, an example embodiment of an initial structure 500 according to the disclosure that includes a ferrous substrate 502, a first aluminum coating layer 504, a first interfacial region 506 that has a composition falling between the ferrous substrate and the first aluminum coating layer and a first ferrous coating layer 508. As reflected in FIG. 5A, prior to the deposition of the first ferrous coating layer, a pattern of recessed regions were formed in the first aluminum coating layer.

As will be appreciated by those skilled in the art, the recessed regions may be formed by various means including, for example, lift-off, cutting, stamping, printing, scribing, etching or milling and may extend partially through the first aluminum coating layer, as shown, or may extend into the interfacial region or even into the ferrous substrate (not shown) as desired. As will also be appreciated by those skilled in the art, the pattern formed by the recessed regions may be regular, varied or random depending on the particular technique(s) utilized in their formation. Further, although illustrated for convenience with substantially vertical sidewalls, the profile of the recessed region will depend to some extent on the particular tools and processes used in their formation. Regardless of the manner in which they are formed, however, the recessed regions allow portions of the subsequently deposited first ferrous coating layer to extend into the first aluminum coating layer, thereby providing for lateral as well as vertical diffusion of the Fe atoms during the subsequent heat treating process and further reducing the heat treatment required to achieve the desired Fe—Al alloy composition(s).

Figure 5B:
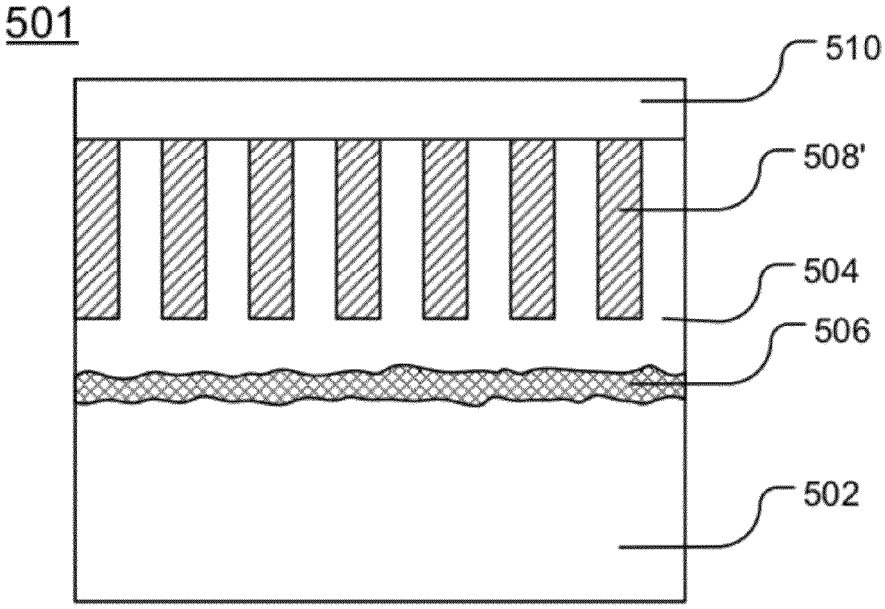

As illustrated in FIG. 5B, an example embodiment of an initial structure 501 according to the disclosure that includes a ferrous substrate 502, a first aluminum coating layer 504, a first interfacial region 506 that has a composition falling between the ferrous substrate and the first aluminum coating layer, a modified first ferrous coating layer 508' and a third metal coating layer 510. Starting with the initial structure as reflected in FIG. 5A, an upper portion of the first ferrous coating layer 508 can be removed to expose an upper surface of the first aluminum coating layer, thereby forming a combined Fe/Al surface pattern. The third metal coating layer which may be, for example, another aluminum layer, can then be deposited on the combined pattern, to provide a means for increasing the Al content of the final surface and/or introducing additional alloying metals to improve the performance of the resulting structure.

Figure 6A:
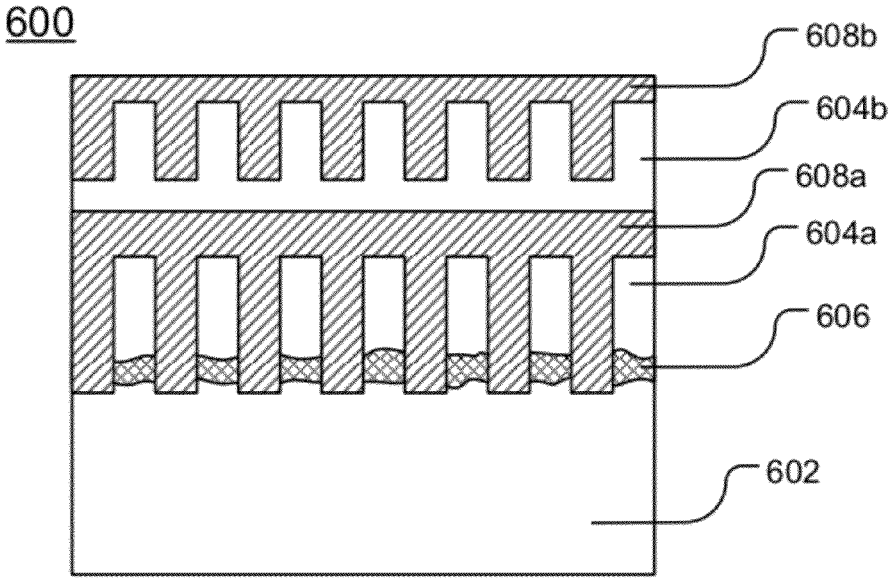
FIGS. 6A and 6B illustrate two additional example embodiments of initial structures manufactured according to the disclosure.

As illustrated in FIG. 6A, an example embodiment of an initial structure 600 according to the disclosure that includes a ferrous substrate 602, a first aluminum coating layer 604*a*, a first interfacial region 606 that has a composition falling between the ferrous substrate and the first aluminum coating layer, a first ferrous coating layer 608*a*, a second aluminum coating layer 604*b* and a second ferrous coating layer 608*b*. As reflected in FIG. 6A, prior to the deposition of the first and second ferrous coating layers, patterns of recessed regions were formed in the first and second aluminum coating layers. As will be appreciated by those skilled in the art, the pattern, size and depth of the recessed regions can vary between layers. Similarly, recessed regions (not shown) could be provided in the first ferrous coating layer 608*a* prior to the deposition of the second aluminum coating layer 604*b*, further reducing the effective diffusion length ($D_{eff}$) to something much less than the total thickness of the protective layer ($X_1$).

Figure 6B:
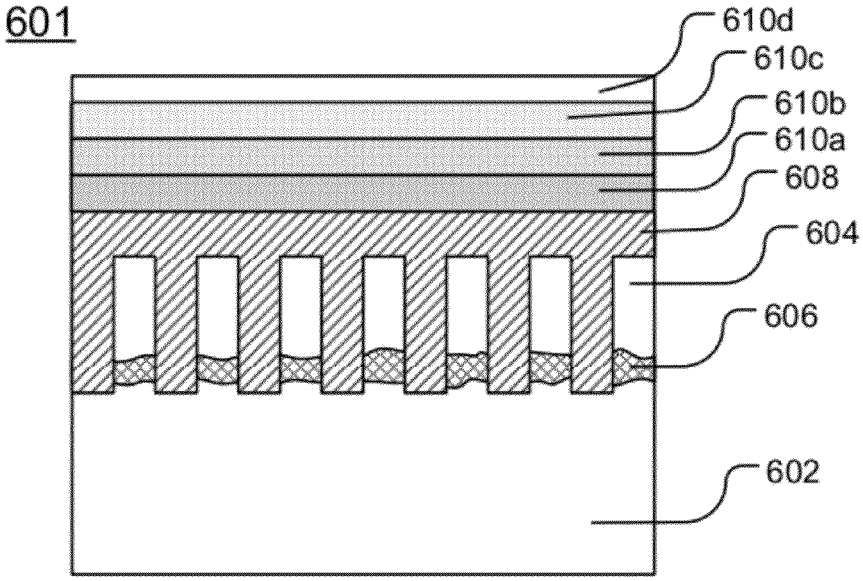

As illustrated in FIG. 6B, an example embodiment of an initial structure 601 according to the disclosure that includes a ferrous substrate 602, a first aluminum coating layer 604, a first interfacial region 606 that has a composition falling between the ferrous substrate and the first aluminum coating layer, a first ferrous coating layer 608 and a plurality of coating layers 610*a-d*. As reflected in FIG. 6B, prior to the deposition of the first and second ferrous coating layers, patterns of recessed regions were formed in the first aluminum coating layer. After deposition of the first ferrous coating layer 608, a plurality of additional coating layers was formed sequentially on the first ferrous coating layer. As suggested by the relative shading, the compositions of the additional coating layers can be adjusted to provide a concentration profile tending, for example, from higher iron content adjacent the first ferrous coating layer to higher aluminum content in the outermost additional coating layer. As will be appreciated by those skilled in the art, although a stepwise graduation of the composition may be sufficient, certain deposition methods can utilized for providing a more gradual transition from an initial concentration to a final concentration across the thickness of a single layer (not shown).

Figure 7A:
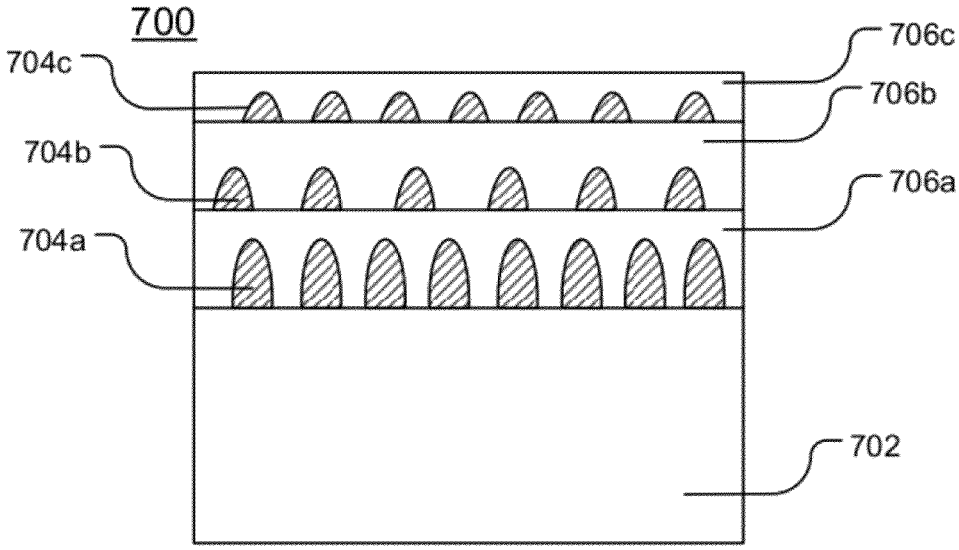
FIGS. 7A-7D illustrate additional example embodiments of initial structures manufactured according to the disclosure.

As illustrated in FIG. 7A, an example embodiment of an initial structure 700 according to the disclosure that includes a ferrous substrate 702, a first metal pattern 704*a*, a first metal layer 706*a*, a second metal pattern 704*b*, a second metal layer 706*b*, a third metal pattern 704*c* and a third metal layer 706*c*. As reflected in FIG. 7A, the metal patterns may be formed by depositing metal from a selected source onto the underlying surface though a grid, screen or mask to form a desired pattern without subsequent processing of a deposited layer. As also reflected in FIG. 7A, the composition, thickness and distribution of the pattern elements may be varied from one layer to the next, thereby adding another means for controlling the distribution of metallic species throughout the final structure.

Figures 7B, 7C, 7D:
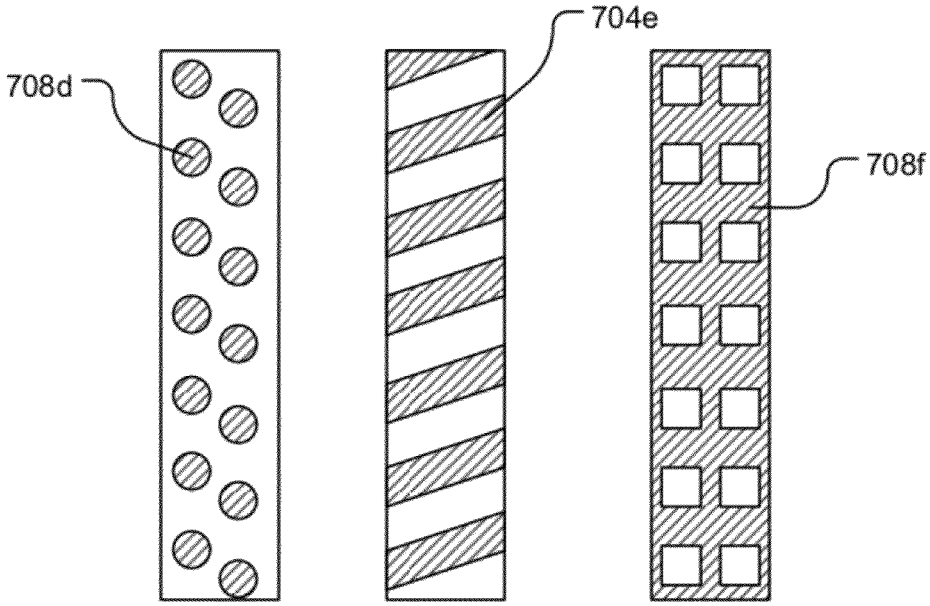
Figure 8:
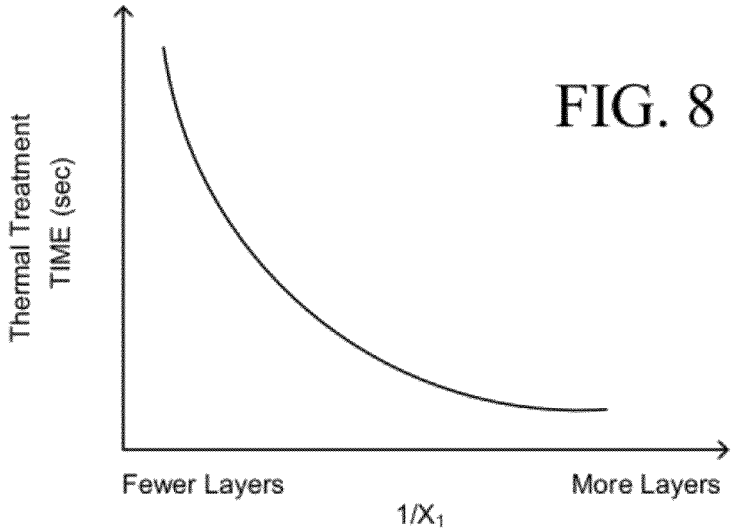
FIG. 8 is a graph illustrating a relationship between the initial structure utilized and the time required for heat treatment.

As will be appreciated by those skilled in the art, the patterns that may be utilized are not particularly limited, but the need to provide the appropriate cumulative volumes of dissimilar materials for the desired distribution of metallic species provide a basis for evaluating any particular pattern. Similarly, patterns and particularly multilayer/multipattern structures should be evaluated for parameters including, for example, the average diffusion length $D_{Lmean}$ and maximum diffusion length $D_{Lmax}$ for a particular configuration to ensure that the heat treatment process will achieve the desired diffusion without exposing the article to excessive thermal processing. FIGS. 7B-D illustrate various patterns that could be utilized with the metal pattern material, identified as 704*d*, 704*e* and 704*f* respectively, deposited on an underlying surface of a dissimilar material.

One skilled in the art will appreciate various modifications can be made to the teachings of the present disclosure without departing from the intended spirit and scope thereof. It is intended that the inventions disclosed herein be limited only by the terms of the appended claims.

We claim:

1. A method of manufacturing corrosion resistant steel articles comprising:

preparing a steel substrate;

applying a first aluminum rich layer to the steel substrate;

forming recesses in the first aluminum rich layer to form a patterned aluminum layer;

applying a first iron rich layer to the patterned aluminum layer to form a composite structure;

removing an upper portion of the first iron rich layer to expose upper surfaces of the patterned aluminum layer to form an iron/aluminum pattern; and maintaining the composite structure at a diffusion temperature for a period sufficient to form an iron aluminide layer from the aluminum rich layer.

2. The method of manufacturing corrosion resistant steel articles according to claim 1, further comprising:

applying a third metal layer to the iron/aluminum pattern to form the composite structure.

3. The method of manufacturing corrosion resistant steel articles according to claim 1, wherein:

the recesses formed in the first aluminum rich layer extend into the steel substrate.

4. The method of manufacturing corrosion resistant steel articles according to claim 1, wherein:

the aluminum rich layer and the iron rich layer define a volume ratio of about 2:1.

5. The method of manufacturing corrosion resistant steel articles according to claim 1, further comprising:

forming a plurality of iron/aluminum alloy layers on the first iron rich layer, wherein the iron/aluminum alloy layers exhibit a concentration gradient with layers having lower iron concentrations arranged more remotely from the steel substrate.

6. The method of manufacturing corrosion resistant steel articles according to claim 1, further comprising:

applying a second aluminum rich layer on the first iron rich layer;

forming recesses in the second aluminum rich layer to form a second patterned aluminum layer; and applying a second iron rich layer to the second patterned aluminum layer to form a composite structure.

7. The method of manufacturing corrosion resistant steel articles according to claim 6, wherein:

the aluminum rich layers and the iron rich layers define a cumulative volume ratio of about 2:1.

* * * * *